US007576302B2

(12) United States Patent
Kim

(10) Patent No.: US 7,576,302 B2
(45) Date of Patent: Aug. 18, 2009

(54) ELECTRIC OVEN

(75) Inventor: Wan Soo Kim, Gwangmyung-si (KR)

(73) Assignee: LG Electronics Inc., Seoul (KR)

( * ) Notice: Subject to any disclaimer, the term of this patent is extended or adjusted under 35 U.S.C. 154(b) by 112 days.

(21) Appl. No.: 11/412,787

(22) Filed: Apr. 28, 2006

(65) Prior Publication Data

US 2007/0131668 A1 Jun. 14, 2007

(30) Foreign Application Priority Data

Dec. 14, 2005 (KR) ..... 10-2005-0123053

(51) Int. Cl.
*A21B 1/00* (2006.01)
*A47B 77/08* (2006.01)

(52) U.S. Cl. ..... 219/392; 108/102; 108/137; 126/337 R; 126/339; 312/236; 312/350; 312/408; 312/410; 312/126; 312/128; 312/132

(58) Field of Classification Search ..... 219/392, 219/736; 108/102, 137; 126/337 R, 339; 312/236, 350, 408, 410, 126, 128, 132
See application file for complete search history.

(56) References Cited

U.S. PATENT DOCUMENTS 3,302,000 A * 1/1967 Sherman ..... 219/393
5,029,721 A * 7/1991 Timpe ..... 220/769
5,272,317 A * 12/1993 Ryu ..... 219/403
6,265,695 B1 * 7/2001 Liebermann ..... 219/385
6,621,053 B1 * 9/2003 Wensink et al. ..... 219/411
6,864,468 B2 3/2005 Kim et al.

* cited by examiner

*Primary Examiner*—Shawntina Fuqua
(74) *Attorney, Agent, or Firm*—McKenna Long & Aldridge LLP

(57) ABSTRACT

An electric oven includes a wire rack having a closed frame, a plurality of longitudinal beams each having a plurality of bent portions, a first end thereof connected to the frame and a second end thereof spaced apart from the closed frame, and a plurality of lateral beams intersecting the longitudinal beam and having first and second ends connected to the frame. The electric oven further includes a cavity defining a cooking chamber and receiving the wire rack. Further, the longitudinal beams are bent in a plurality of directions and the second ends of the longitudinal beams are bent towards the first end of the longitudinal beams such that a direction where heat is transmitted from the first end of the longitudinal beam is opposite to a direction where the heat is transferred to the second end of the longitudinal beam.

8 Claims, 7 Drawing Sheets

ELECTRIC OVEN

BACKGROUND OF THE INVENTION

1. Field of the Invention

The present invention relates to an electric oven, and more particularly, to an electric oven that can distribute heat transmitted from a tray member more equally through food by improving the structure of the tray member.

2. Description of the Related Art

An electric oven is generally used for baking or roasting food by heating the food using heat and steam generated from the food and confined in the oven. Therefore, the food can be cooked with a good taste without being burnt or hardened by contraction, which caused when the food is directly roasted by fire.

A typical electric oven includes a cavity in which food is loaded and a door for opening and closing the oven to load and withdraw the food in and from the cavity. A heat source such as a heater is placed in the cavity.

The heater includes at least one of an upper heater mounted on an upper portion of the cavity, a lower heater mounted on a lower portion of the cavity and a convection heater mounted on a rear portion of the cavity.

The electric oven heats the food by transferring thermal energy to the food by turning on one or more of the upper, lower and convection heaters or by alternately turning on them.

A food-supporting member such as a wire rack or a tray having a predetermined thickness.

In order to equally heat the food from an outer surface to a core portion in the electric oven, a variety of food supporting member have been commercialized. That is, in order to enhance the heating efficiency, a heater is mounted on a bottom of a tray on which the food is loaded. Alternatively, a high conductive material is applied on a bottom of a grill plate to uniformly maintain a temperature of the grill plate.

However, when the heater is mounted on the bottom of the tray, the overall weight of the oven increases and an additional terminal for electrically connecting the heater must be further installed.

Furthermore, even when the heater is mounted on the bottom of the tray, the heat is not yet effectively transferred to a core portion of the food, thereby retarding the cooking speed. In addition, the overall heat efficiency of the electric oven is deteriorated.

SUMMARY OF THE INVENTION

Accordingly, the present invention is directed to an electric oven, which substantially obviates one or more problems due to limitations and disadvantages of the related art.

An object of the present invention is to provide an electric oven having an improved tray that can effectively transfer ambient heat toward a core of the food loaded on the tray, thereby reducing the cooking time.

That is, an object of the present invention is to provide an electric oven in which a food supporting structure is improved to transfer heat to firstly a core portion, thereby uniformly cooling the food.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an electric oven including: a wire rack including: a closed frame; a plurality of longitudinal beams each having a plurality of bending portions, a first end connected to the frame and a second end placed in the closed frame; and a plurality of lateral beams intersecting the longitudinal beam and having first and second ends connected to the frame; and a cavity defining a cooking chamber and receiving the wire rack, wherein the bending portions of the longitudinal beam are formed such that a direction where heat is transmitted from the first end of the longitudinal beam is opposite to a direction where the heat is transferred to the second end of the longitudinal beam.

An electric oven including: a tray including a body on which food seats and a heat wire coupled to the body to enhance heat conductivity; a cavity for receiving the tray; and a heater mounted at least one of upper and lower portions of the cavity.

According to the present invention, when the oven operates, the heat is firstly transferred to a core portion of the food by the improved food-supporting member. That is, by the improved food supporting member, the heat transfer efficiency into the food is improved, thereby equally roasting outer and core portions of the food.

By effectively transferring the heat, the cooking time can be reduced, thereby saving the electric energy.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
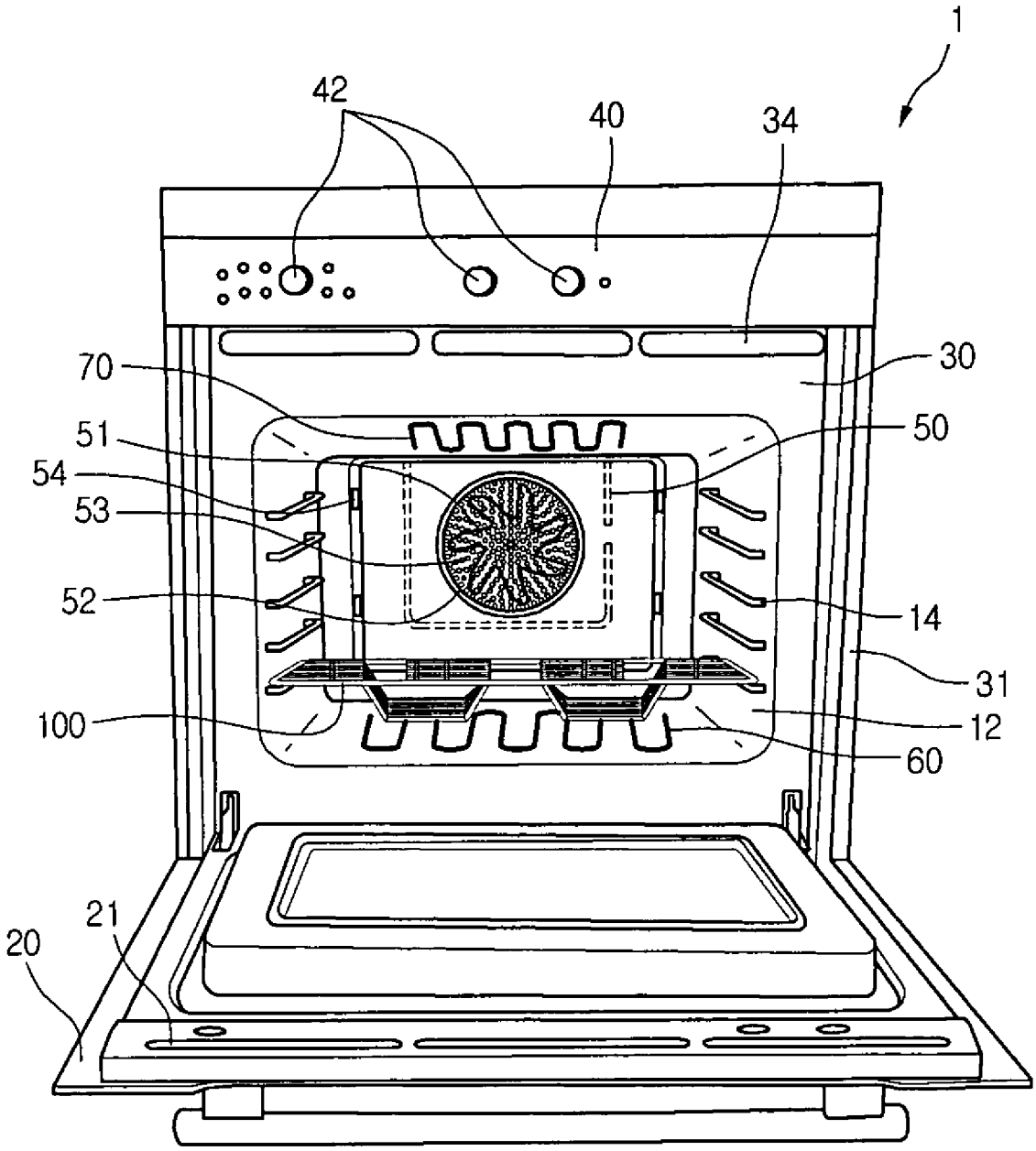
FIG. 1 is a front view of an electric oven according to an embodiment of the present invention.

FIG. 1 is a front view of an electric oven according to an embodiment of the present invention.

Referring to FIG. 1, an electric oven 1 has a cavity defining a cooking chamber.

The cavity 10 is provided with a front opening that is opened and closed by a door 20 that is pivotally mounted. A front plate 30 is formed on a front portion of the cavity 10 and side trims 31 are formed on left and right sides of the front plate 30. That is, the side trims 31 are stepped with the front plate 30 by projecting frontward the front plate 30. When the door 20 is closed, an inner frame of the door 20 contacts the front plate 30 and the side trims 31, thereby preventing the heat formed in the cavity from leaking.

Meanwhile, the front plate 30 is provided at an upper portion with a communication hole 34 through which air that is heated while passing an inside of the door 20 is introduced into an exhaust duct (not shown). That is, a plurality of door glasses are arranged inside the door 20 and indoor-air intake holes are formed on the upper and lower sides of the door 20. The air introduced inside the door through the indoor air intake holes flows along passages between the door glasses to cool down the door 20. The air that is heated while flowing the inside of the door 20 is exhausted through an exhaust hole 21 formed on a rear-upper side of the door. The exhaust hole 21 communicates with the communication hole 34. An exhaust duct is mounted on an outer-upper side of the cavity 30. The air exhausted through the communication hole 34 is exhausted to the indoor side through the exhaust duct and the cavity 30

In addition, a control panel 40 having a plurality of control dials 42 is provided above the exhaust hole 34.

Meanwhile, upper and lower heaters 60 and 70 are respectively provided on inner-top and inner-bottom portions of the cavity 10. A convection fan 51 driven by a motor and generating air current is mounted on a rear side of the cavity 10. The convection fan 51 forcedly circulates the interior air of the cavity 10 to distribute the heat emitted from the convection heater 50 equally through the food.

A protection cover 52 is mounted in front of the convention fan 51. The protection cover 52 is provided at a front portion with air intake holes 53 and at side portions with air exhaust holes 54. Therefore, the air introduced into the protection cover 52 through the air intake hole 53 is heated by the convection heater 50 and then exhausted into the cavity 30 through the air exhaust holes 54.

Meanwhile, rack guides are mounted on inner sidewalls of the cavity 10. The rack guides extend in a depth direction and are spaced apart from each other in a vertical direction. The rack guides 14 support opposite side end portions of a food supporting member and guide the insertion and withdrawal of the food supporting member into and out of the cavity. As the plurality of the rack guides are mounted on the both sidewalls of the cavity and equally spaced apart from each other by a distance, various foods having a variety of sizes can be loaded at a proper height in the cavity 10.

Here, the food-supporting member guided by the rack guides 14 may be a wire rack or a tray member.

In this embodiment, the food-supporting member is the wire rack.

Figure 2:
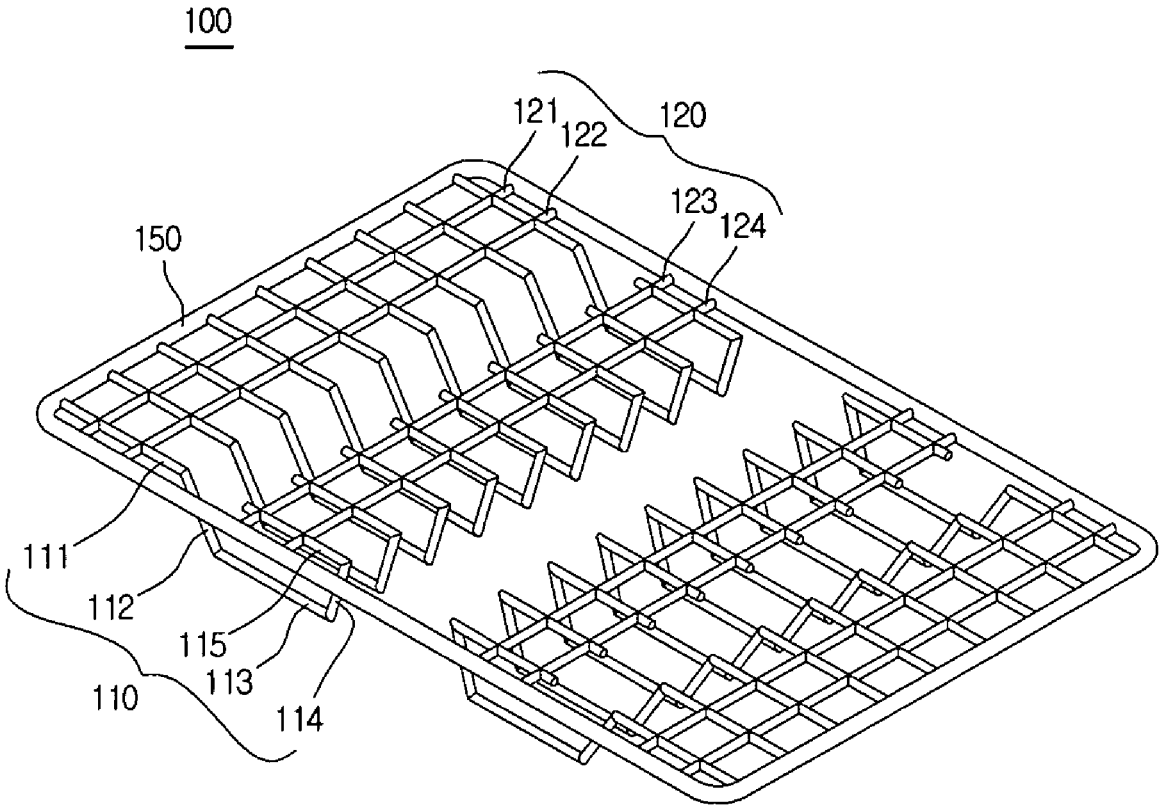
FIG. 2 is a perspective view of a wire rack of the electric oven of FIG. 1.

FIG. 2 is a perspective view of a wire rack of the electric oven of FIG. 1.

The wire rack 100 includes a plurality of longitudinal beams 110 and a plurality of lateral beams 120 intersecting the longitudinal beams 110. Opposite ends of each of the longitudinal and lateral beams 110 and 120 are coupled to a frame 150. The food seats on the beam structure formed by the intersecting longitudinal and lateral beams 110 and 120. Left and right sides of the beam structure is symmetrical. Here, the longitudinal and lateral beams 110 and 120 are preferably formed of a high conductive material such as aluminum. The frame 150 may be formed of aluminum or steel.

Each of the longitudinal beams 110 has an extending portion 111 extending toward a mid-portion of the wire rack 100, a downward portion 112 inclined downward from the extending portion, a first horizontal portion 113 horizontally extending from the inclined portion 112, an upward portion inclined upward from the first horizontal portion 113, and a second horizontal portion horizontally extending from the upward portion 114 toward the extending portion 111. An extreme end of the second horizontal portion 115 is spaced apart from the extending portion 111. The second horizontal portion 115 and the extending portion 111 may be identical in an elevation to each other. Alternatively, an elevation of the second horizontal portion 115 may be lower than the extending portion 111. Each of the extending and second horizontal portions 111 and 115 intersects at least two lateral beams 120. That is, the extending portion 111 fixedly intersects first and second rows 121 and 122 of the lateral beams 120. Opposites ends of each of the first and second rows 121 and 122 are fixed to the frame 150. The frame 150 is disposed on the rack guide 14. By this structure, the thermal energy transferred to the wire rack 100 is transferred from a bottom center of the food to a periphery portion of the food. Therefore, a phenomenon where the periphery portion is burn while the periphery portion is half-done can be avoided. Then, the number of longitudinal and lateral beams 110 and 120 can be variably determined considering the size of the wire rack 100 and the volume of the cavity.

Meanwhile, the lateral beams 120 further include third and fourth rows 123 and 124 fixedly intersecting the second horizontal portions 115 of the longitudinal beams 110. The lateral beams 120 fixedly intersect the longitudinal beams 110 and fixed to the frame 150. That is, the lateral beams 120 serve to support the longitudinal beams 110.

In addition, the frame 150 is preferably formed of a material having a predetermined bending strength that can prevent the frame from bending by the weight of the food seating on the wire rack 100.

Figure 3:
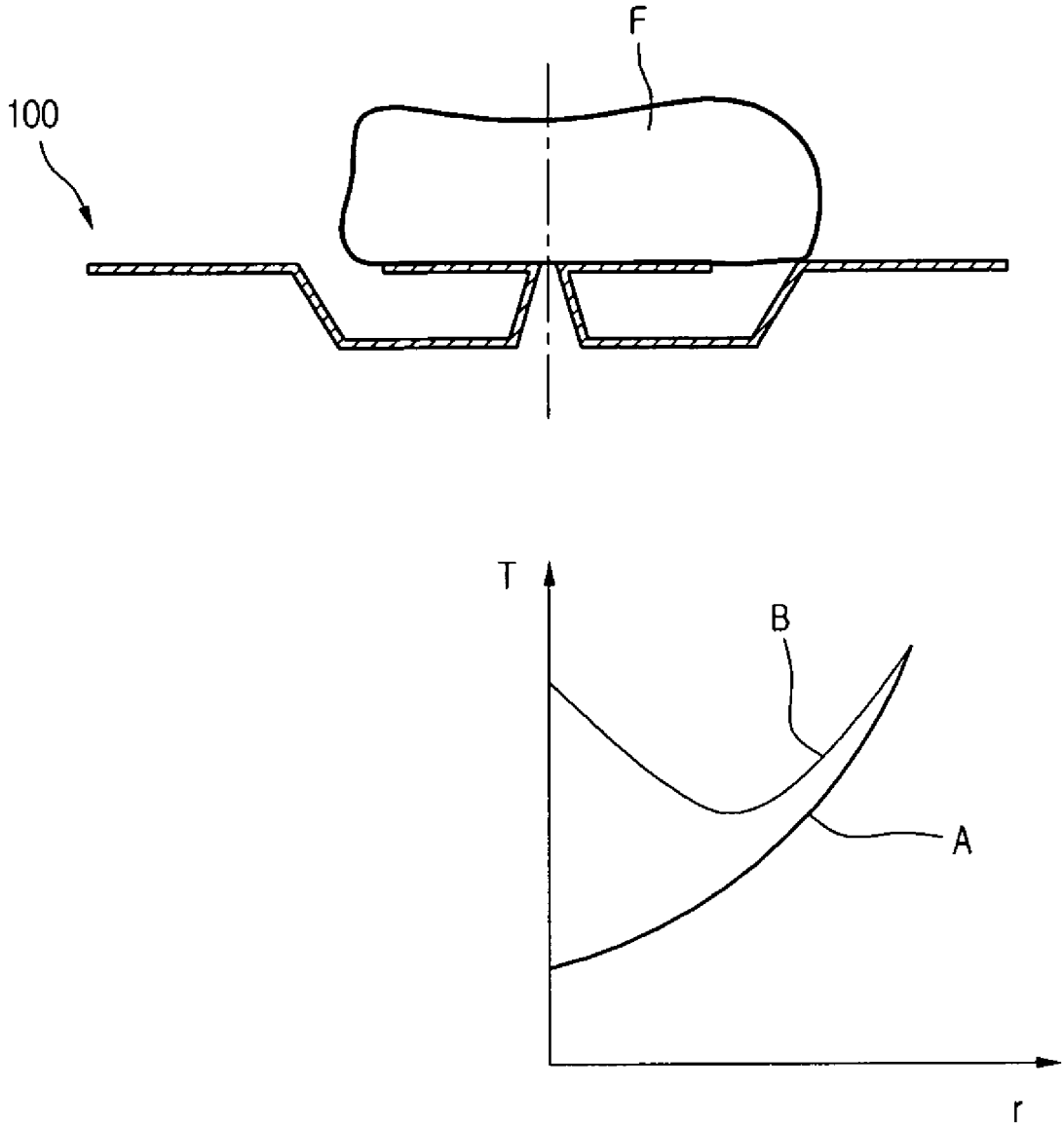
FIG. 3 is a graph illustrating a temperature distribution with respect to a shape of longitudinal beams and each location of the longitudinal beams of the wire rack of FIG. 2.

FIG. 3 is a graph illustrating a temperature distribution with respect to a shape of the longitudinal beams and each location of the longitudinal beams of the wire rack.

Referring to FIG. 3, the graph shows a temperature variation at each location of the food F when the food F seats on the wire rack 100 and roasted. The X and Y-axis of the graph respectively represent a distance from a mid-portion of the wire rack and an internal temperature variation at each location of the food. In the graph, a curve A represents a temperature variation when the food seats on a conventional wire rack where the longitudinal beams are arranged on an identical horizontal plane. A curve B shows a temperature variation when the food seats on the wire rack according to the present invention.

As can be noted from the curve A, when the food seats on the conventional wire rack, a temperature difference between the outer portion of the food and the core portion of the food is relatively high. Therefore, the food F is not uniformly roasted. Moreover, since the thermal energy is not sufficiently transferred to the core portion of the food, the periphery portion of the food is burnt while the core portion is half-cooked. In addition, since the electric oven has to operate until the core portion is completely cooked, the cooking time as well as the thermal energy consumption increases.

However, as can be noted from the curve B, the temperature is relatively uniform through the wire rack 100 of the present invention. Therefore, the food is uniformly cooked. Particularly, since the thermal energy is transferred from the core portion to the periphery portion of the food, the core and periphery portions of the food F are equally cooked. In addition, since the cooking time can be shortened, the power consumption can be reduced.

Figure 4:
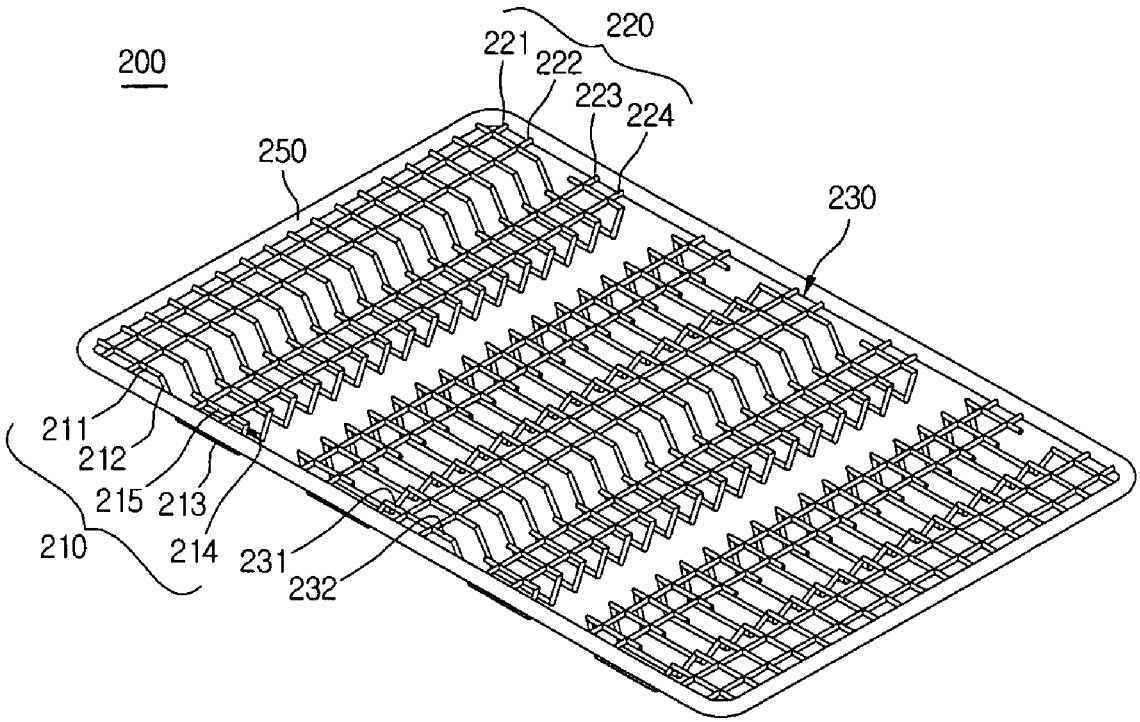
FIG. 4 shows a modified example of the wired rack according to the present invention.

FIG. 4 shows a modified example of the wired rack according to the present invention.

Referring to FIG. 4, the beam structure of FIG. 2 is provided by a plurality.

That is, beam structures each having longitudinal and lateral beams 210 and 220 intersecting with each other are formed at left and right sides of a frame 250. Additional two beam structures are arranged at a mid-portion of the frame 250.

Likewise the longitudinal beam of FIG. 2, a longitudinal beam of the wire rack 200 includes an extending portion 211, a downward portion 212, a first horizontal portion 213, an upward portion 214, and a second horizontal portion 215. The extending portion fixedly intersects first and second rows 221 and 222 of the lateral beams 210 and fixed to the frame 250. The frame 250 is disposed on the rack guides 14 when the wire rack 200 is inserted into the cavity. Ends of the longitudinal and lateral beams 210 and 220 are fixed to the frame 250 not to move. Here, the longitudinal and lateral beams 210 and 220 are preferably formed of a high conductive material such as aluminum.

The beam structure formed on the mid-portion of the wire rack 200 is basically identical to the left and right beam structures. Particularly, a pair of beam structures are integrally connected to the lateral beams and symmetrical.

By the above-described structure, two lumps of food seat on left and right sides of the wire rack 200. That is, when each lump of the food is small and the number of the lumps of food to be cook is two or more, the above-described wire rack 200 can be more effectively used.

Figure 5:
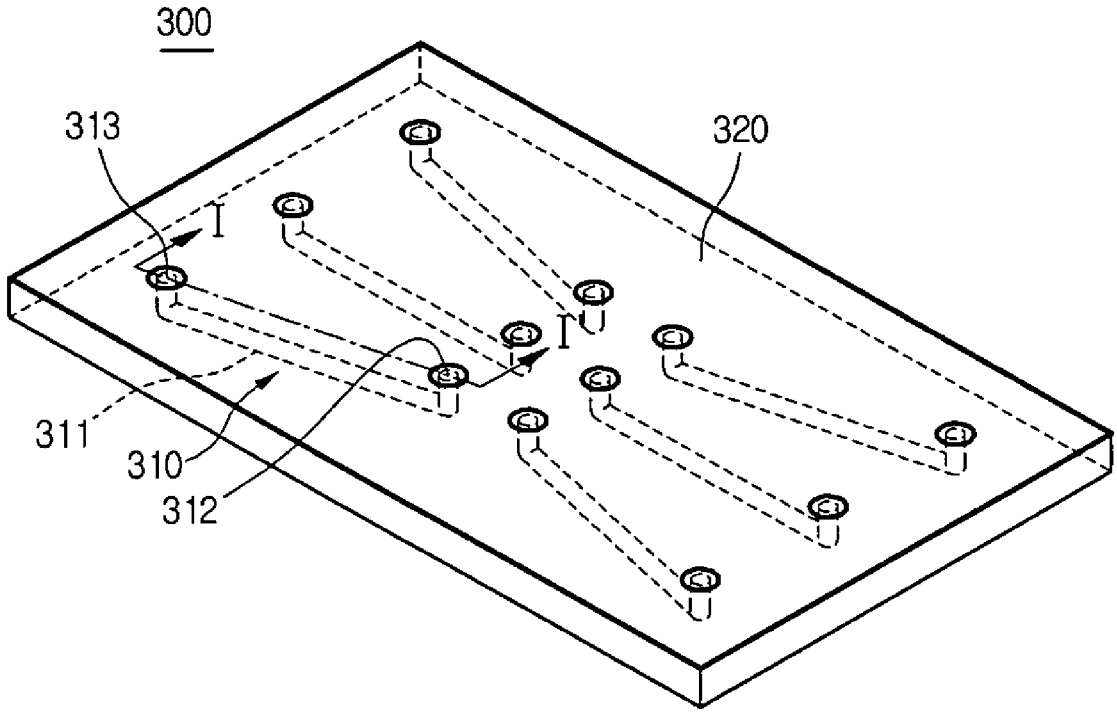
FIG. 5 is a perspective view of a tray according to an embodiment of the present invention.
Figure 6:
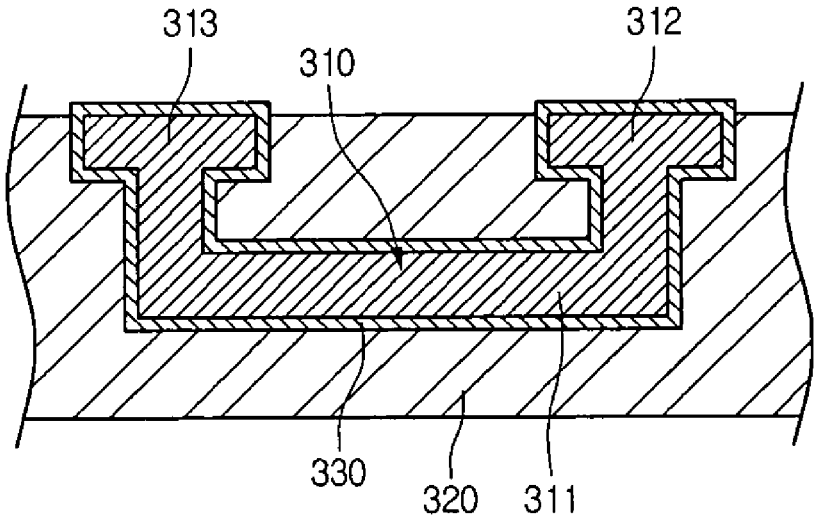
FIG. 6 is a sectional view taken along line I-I' of FIG. 5.
Figure 7:
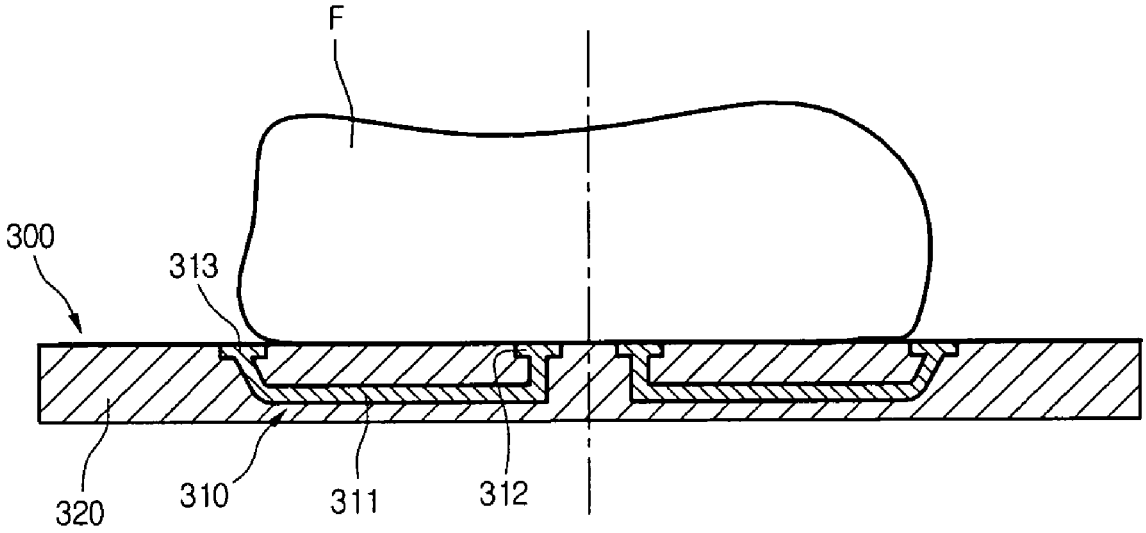
FIG. 7 is a sectional view of the tray of FIG. 5, when food seats on the tray.

FIG. 5 is a perspective view of a tray according to an embodiment of the present invention, FIG. 6 is a sectional view taken along line I-I' of FIG. 5, and FIG. 7 is a sectional view of the tray of FIG. 5, when food seats on the tray.

Referring to FIGS. 5 through 7, a tray 300 includes a rectangular body 320, a plurality of heat wires 310 for improving the heat conduction, and a coating layer 330 coated on the heat wire 310.

The body 320 may be formed of steel. Food F seats on the body 320 and the body 320 is inserted into the cavity 10. The plurality of heat wires may be buried in the body 320 or attached on an outer bottom of the body 320.

The heat wires 310 may be formed of a material having heat conductivity higher than that of the body 320. The heat wire 310 may be buried in the body 320. At this point, opposite ends of the heat wire 310 are projected through the inner or outer bottom of the body 310 and attached on the bottom of the body 310.

The heat wire 310 includes a heat conducting portion 311 for absorbing radiation generated from, for example, the lower heater 60 and a contacting portion by which the thermal energy absorbed in the heat conducting portion 311 is directly transferred to the food F. The contacting portion includes an inner contacting portion 312 closer to a center of the tray 300 and an outer contacting portion 313 closer to a periphery of the tray.

The coating portion 330 coated on the heat wires 310 is preferably formed of a material containing fluorine resin. The thermal energy transferred to the heat wires 310 are equally transferred to the inner and outer contacting portions 312 and 313. Therefore, the periphery and core portions of the food F are equally heated, thereby uniformly cooking the food.

That is, when the heat wires 310 are not provided to the tray 300, the heat conductivity is relatively low at the core portion of the food as compared with the periphery portion of the food. However, in the present invention, since the heat wires 310 are installed on the tray 300, the thermal energy transferred to the core portion increases, thereby distributing heat equally through the food.

Figure 8:
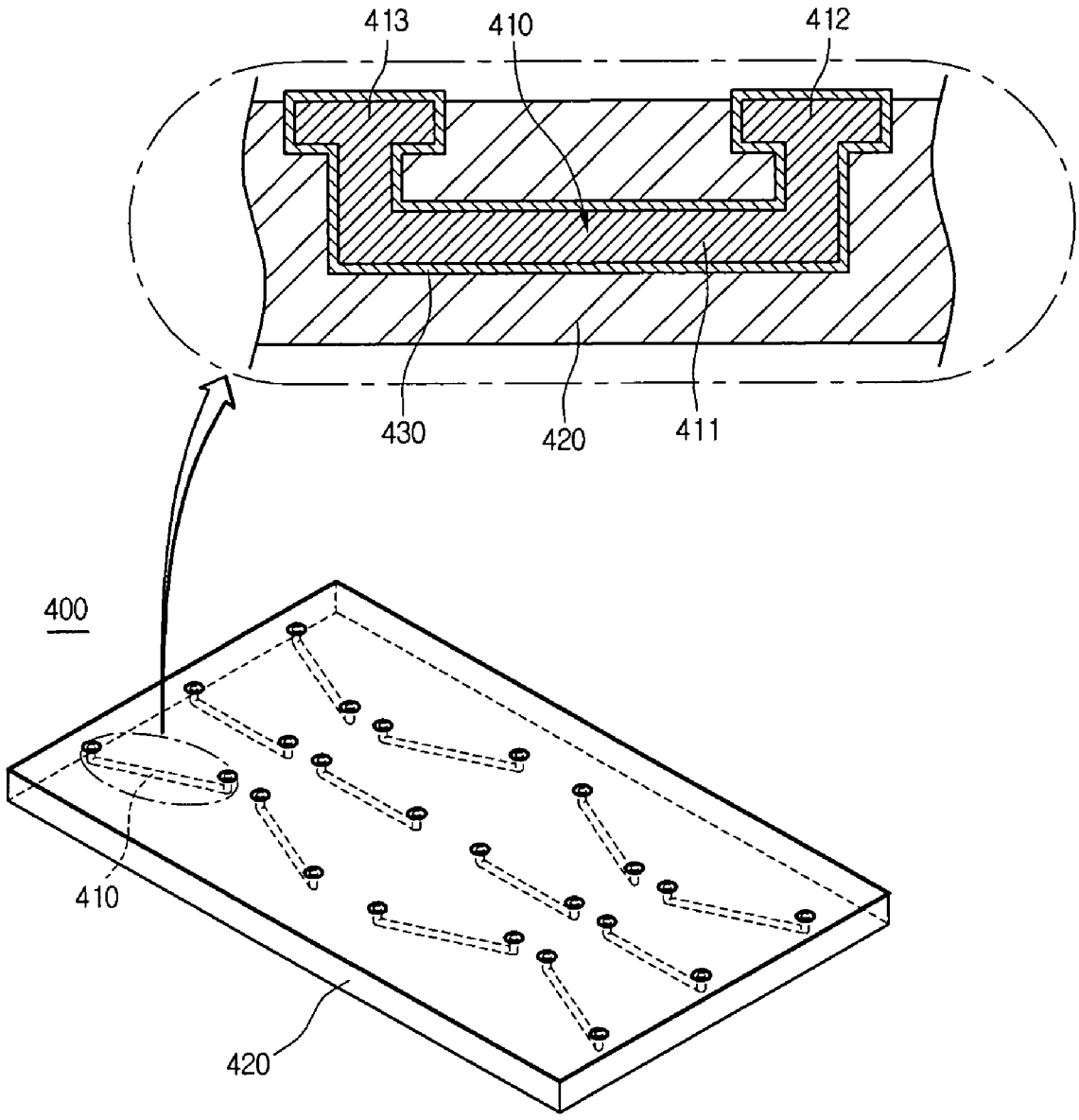
FIG. 8 is a perspective view of a modified example of the tray of FIG. 5 according to another embodiment of the present invention.

FIG. 8 is a perspective view of a tray according to another embodiment of the present invention.

Referring to FIG. 8, the heat wire structure of FIG. 5 is provided by a plurality in this embodiment.

Likewise the tray of FIG. 5, a tray 400 of this embodiment includes a rectangular body 420, a plurality of heat wires 410 for improving the heat conduction, and a coating layer 430 coated on the heat wire 310. The heat wire 410 includes a heat conducting portion 411 for absorbing radiation generated from, for example, the lower heater 60 and contacting portions by which the thermal energy absorbed in the heat conducting portion 411 is directly transferred to the food F.

In this embodiment, there are several close locations where the contacting portions are closely arranged to each other on the surface of the tray 400. Therefore, several small lumps of food can seat on the respective close locations. That is, the lump of food is aligned with the close location to be uniformly roasted.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An electric oven comprising:

a wire rack including:

a closed frame;

a plurality of longitudinal beams each having a plurality of bent portions, a first end thereof connected to the frame and a second end thereof spaced apart from the closed frame; and a plurality of lateral beams intersecting the longitudinal beam and having first and second ends connected to the frame; and a cavity defining a cooking chamber and receiving the wire rack, wherein the longitudinal beams are bent in a plurality of directions and the second ends of the longitudinal beams are bent towards the first end of the longitudinal beams such that a direction where heat is transmitted from the first end of the longitudinal beam is opposite to a direction where the heat is transferred to the second end of the longitudinal beam.

2. The electric oven according to claim 1, wherein the longitudinal beam includes:

an extending portion extending from the frame;

a downward portion inclined downward from the extending portion;

a first horizontal portion horizontally extending from the downward portion;

an upward portion inclined upward from the first horizontal portion; and a second horizontal portion horizontally extending from the upward portion toward the extending portion.

3. The electric oven according to claim 2, wherein opposing ends of the extending portion and the second horizontal portion are spaced apart from each other by a predetermined distance.

4. The electric oven according to claim 2, wherein the second horizontal portion is placed at a horizontal plane identical to that of the extending portion.

5. The electric oven according to claim 1, wherein the first end of the longitudinal beam further extends from the frame and is bent at a plurality of points such that a second end oriented toward an outer side of the wire rack.

6. The electric oven according to claim 1, wherein the longitudinal beam is bent or curved such that the second end can horizontally extend by a predetermined length.

7. The electric oven according to claim 1, further comprising at least an additional beam structure including longitudinal beams and lateral beams that mutually intersect is provided at an inner space of the closed frame, wherein the additional beam structure is bilaterally symmetrical so that both ends of the longitudinal beams face each other.

8. The electric oven according to claim 1, wherein the frame is formed of aluminum or steel.

* * * * *